United States Patent [19]

Fretz, III et al.

[11] Patent Number: 4,764,855

[45] Date of Patent: Aug. 16, 1988

[54] GLOBE SECUREMENT MEANS

[75] Inventors: John A. Fretz, III, Huntingdon Valley; Robert T. Gallagher, Philadelphia, both of Pa.

[73] Assignee: Kidde Consumer Durables Corp., Bala Cynwyd, Pa.

[21] Appl. No.: 47,366

[22] Filed: May 6, 1987

[51] Int. Cl.[4] ..... F21V 17/00

[52] U.S. Cl. ..... 362/433; 362/440

[58] Field of Search ..... 362/433, 440

[56] References Cited

U.S. PATENT DOCUMENTS

| | | | |
|---|---|---|---|
| Re. 17,979 | 2/1931 | Wolarsky . | |
| 1,002,592 | 9/1911 | Little, Jr. . | |
| 1,154,358 | 9/1915 | White . | |
| 1,172,649 | 2/1916 | Wakefield . | |
| 1,198,931 | 9/1916 | Kulas | 362/433 |
| 1,249,652 | 12/1917 | Mersing . | |
| 1,746,339 | 2/1930 | Doane . | |
| 1,975,068 | 10/1934 | Arras et al. . | |
| 2,012,720 | 8/1935 | Jaffe . | |
| 2,063,095 | 12/1936 | Heath et al. . | |
| 2,240,659 | 5/1941 | McKinnie . | |
| 2,354,154 | 7/1944 | Steber . | |
| 2,378,121 | 6/1945 | Baker . | |
| 2,783,368 | 2/1957 | Jaffe . | |
| 3,184,595 | 5/1965 | Hooper . | |
| 4,327,403 | 4/1982 | Capostagno et al. | 362/306 |
| 4,426,677 | 1/1984 | Dennis | 362/438 |
| 4,428,032 | 1/1984 | Workman | 362/96 |
| 4,531,179 | 7/1985 | Baker | 362/371 |

*Primary Examiner*—Tony M. Argenbright

*Attorney, Agent, or Firm*—Seidel, Gonda, Goldhammer & Abbott

[57] ABSTRACT

An assembly for supporting a glass globe having a recessed neck portion the globe is retained within a receptacle or holder by a separate arcuate band of metal which is compressed and resiliently retained within the receptacle and has formed on surface portions of its perimeter a pair of spaced extrusions or nibs which fit within the recess of the globe neck. The band is additionally provided with a threaded bushing for receipt of a screw which when seated in the bushing holds the band in position within the holder and provides, with the nibs, a three-point suspension for the globe.

5 Claims, 2 Drawing Sheets

FIG. 3
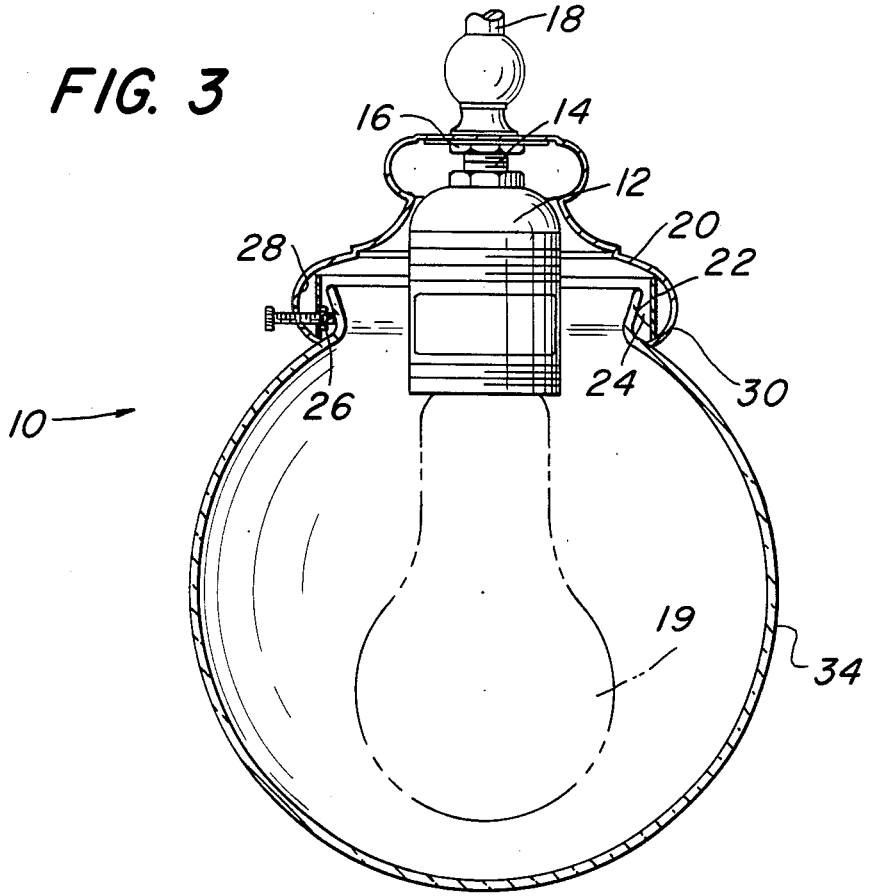
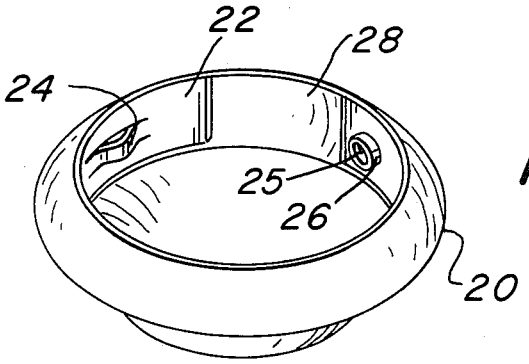
FIG. 2

GLOBE SECUREMENT MEANS

BACKGROUND OF THE INVENTION

The present invention is directed generally to lighting fixtures and more particularly to means for securing a globe (also commonly referred to as a glass with a neck type fitter) or reflector to a bulb-receptacle or housing.

Prior means for securing a globe to a lighting fixture typically consists of the use of a plurality of securement means, such as screws, arranged in spaced array around the perimeter of the neck of the receptacle and adapted to seat within a recess provided in the neck of the globe. Such an arrangement is shown in U.S. Pat. No. 4,531,179.

An alternative mounting means is shown in U.S. Pat. No. 4,327,403. This patent discloses a globe connector for light fixtures utilizing a resilient clip having a number of spring elements or clamping arms which resiliently support the globe by means of their retention within the annular neck of the globe. Still another arrangement is shown in U.S. Pat. No. 2,783,368. This patent discloses a lighting fixture consisting of a glass bowl mounting ring secured to the overlying fixture by means of bayonnet lugs. The upper surface of the ring is provided with a plurality of rectangular openings which conform with the shape and size of the lugs. The globe together with the annular shaped protector ring is advanced upwardly into the lighting fixture so that the bayonnet lugs and slots mate to securely fasten the globe and protector ring to the lighting fixture. U.S. Pat. No. 2,012,720 discloses a lighting fixture which utilizes a separate thrust ring placed around the upper perimeter of the glass bulb to protect it against fracture by the thumb screws.

Another approach, as seen in U.S. Reiussue Pat. No. Re. 17,979, U.S. Pat. Nos. 2,354,154 and 2,240,659 is to form integral with the receptacle itself a number of indents or tabs, or to solder or rivet lugs to the skirt of the receptable which, in cooperation with an adjustable screw carried by the skirt of the receptacle, is used to hold the bead or lip of the shade or globe within the receptacle. Still another and more elaborate approach is shown in U.S. Pat. Nos. 1,002,592 and 1,746,339. The technique of securement used in these last mentioned patents is to provide the globe with nibs, and the casing of the receptacle with a spring cam device so that as the globe is turned within the receptacle the nibs ride along the cam and are firmly drawn up against the lower edge of the casing.

SUMMARY OF THE INVENTION

Among the several advantages of this invention is the provision of means for securing a globe or shade to a receptacle which minimizes the need to deface outer surface portions of the receptacle as by forming detents or holes at various points around its perimeter. Another advantage is the provision of securement means which is simple, easily manufactured and which improves the aesthetic appearance of the receptacle.

A still further advantage is to provide an expedient means for retrofitting or replacing defective assemblies, such as those using a number of screws to secure the globe, in which the screws have rusted out.

In achievement of the foregoing advantages, the preferred embodiment of the invention comprises the provision of a separate arcuate band of resilient material, such as a metal collar, which can be snap-fitted or resiliently retained within the skirt portion of a receptacle. The band or collar is provided at spaced intervals around its perimeter with two or more retaining lugs or bosses and a single aperture which has secured in position over it a threaded bushing. The skirt of the receptacle which receives the band is also provided with an aperture. When the band is installed within the receptacle skirt portion the two apertures are brought into alignment and a thumb screw threadably engaged within the bushing. This acts to lock the band in position within the skirt portion of the receptacle. The globe may then be inserted within the mouth of the receptacle and secured in place by rotating the thumb screw to cause its inwardly presented end to seat against the recessed neck of the globe. The thumb screw in combination with the tabs formed in the collar securely lock the globe in position within the receptacle.

This simplified structure minimizes the need to mar external surfaces of the receptacle. Provides an easy means for assembling the globe to the receptacle and reduces the number of machining steps required in the manufacture of th finished receptacle. Additionally, it provides a convenient means for retrofitting defective assemblies, such as those using a three screw support.

For the purpose of illustrating the invention, there is shown in the drawings forms which are presently preferred; it being understood, however, that this invention is not limited to the precise arrangements and instrumentalities shown.

BRIEF DESCRIPTION OF THE DRAWINGS

FIG. 2 is a perspective showing of the globe holder with the retaining ring or collar seated, and FIG. 3 is a sectional view of a lighting fixture showing the completed assembly.

Corresponding reference characters indicate corresponding parts throughout the several views of the drawings.

DESCRIPTION OF PREFERRED EMBODIMENT

Figure 1:
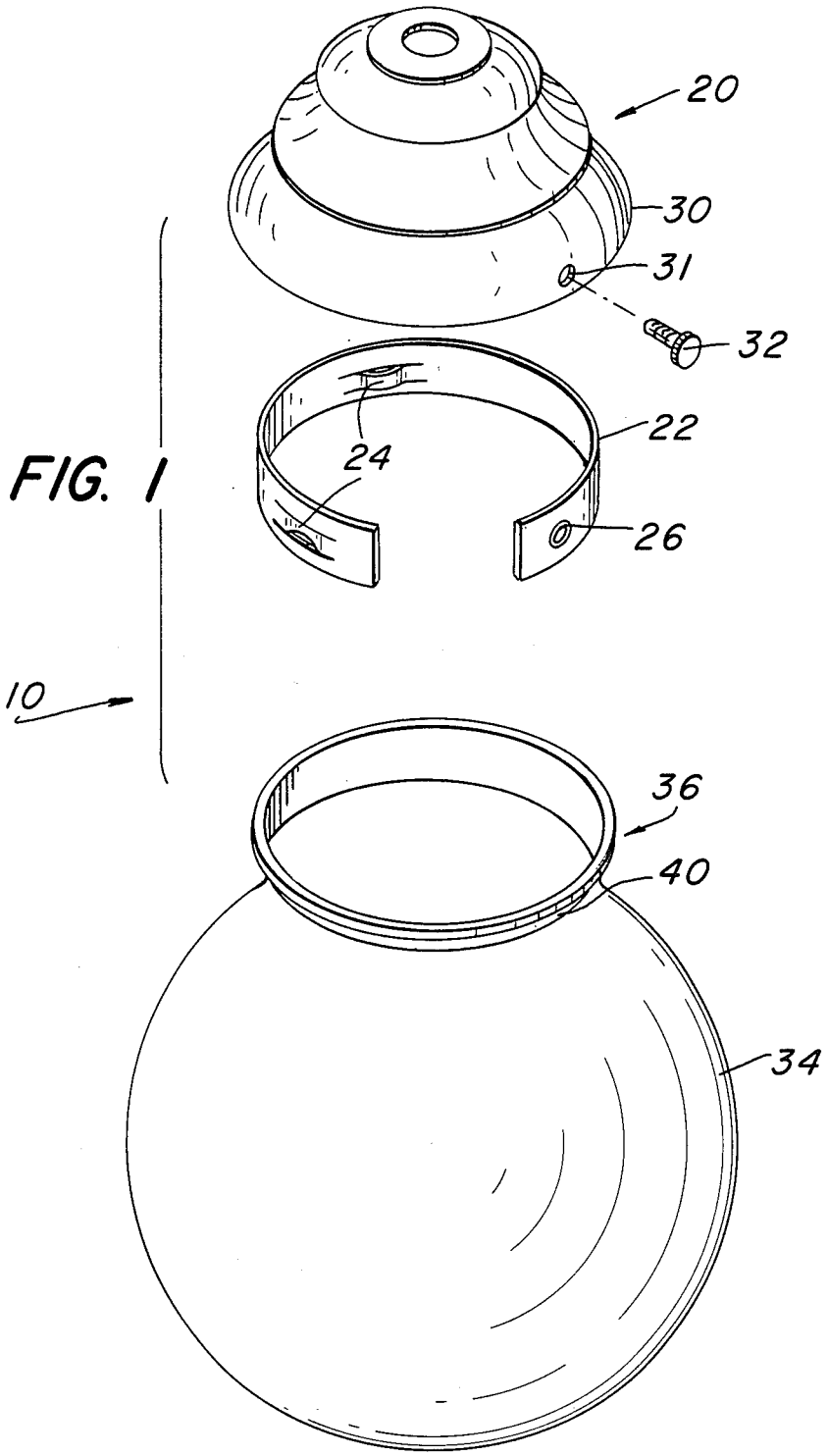
FIG. 1 is an exploded view of an assembly for mounting a globe in accordance with the present invention showing the component parts of the overall assembly and their interrelationship.

Referring to the drawings, there is generally indicated at (10), see FIG. 3, a light fixture embodying the invention. The fixture is suspended from the wall or ceiling by suitable means, not shown, and comprises in essential part a light socket (12) having a threaded neck portion (14). This is secured by a lock nut (16) to an internally threaded brass tube (18) which in turn is secured to the wall or ceiling. Electrical wiring, not shown, connects the bulb (19) to an electrical source of energy. Clamped between the lock nut (16) and lower surface portions of the brass tube (18) is the holder or receptacle (20). The holder houses a separate arcuate band or collar of metal (22) which is resiliently seated within the holder (20). The collar (22) has struck from its surface a pair of extruded slots or bosses (24) arranged in circumferentially spaced relation. These can best be seen in FIG. 1. Provided on a surface opposite the bosses (24) is an aperture (25) carrying a threaded bushing (26). The collar in its free state, is of larger diameter than when in its seated position as seen in FIG. 3. To position the collar (22) in the holder (20), the collar is compressed and then released within the holder to form a snapfit within the concavity (28) formed in the collar's skirt portion (30).

A typical construction when using a holder made of 0.020 brass with a skirt having an outside diameter of $2\frac{7}{8}$ inches and a globe opening of 2 7/16 inches is to use a collar of 0.025 brass, 7/16 wide having a length of $8\frac{1}{8}$ inches and a free standing diameter of $3\frac{3}{8}$ inches. The skirt of holder (20) is apertured at (31) as seen in FIG. 1, to permit insertion of a thumb screw (32). When threaded into place, the thumb screw acts to circumferentially lock the collar (22) in place within the holder. The globe (34) has a recessed neck portion (36). When the neck portion of the globe is inserted in the holder the bosses (24) extend into the recess (36) provided in the neck portion of globe (34). To secure the globe in place within the holder requires only that the thumb screw (32) be threaded through the bushing (26) into contact with the inner wall (40) of recess (36).

It will be appreciated that while the embodiment of the invention which is depicted shows the globe as having a recessed neck portion, the invention is equally applicable to a globe having a neck provided with an annular bead, or one in which th globe neck is provided with spaced detented portions which coincide with the bosses or tabs (24) formed on collar (22). It should also be appreciated that the securement means for holding the globe within the receptacle can take any of a number of forms. For example, it is possible to use a self-tapping screw thus eliminating the need for a threaded bushing or alternatively the wall surrounding the aperture formed in either the collar (22) or the skirt (30) of holder (20) can be threaded to accommodate the thumb screw (32).

The present invention may be embodied in other specific forms without departing from the spirit or essential attributes thereof and, accordingly, reference should be made to the appended claims, rather than to the foregoing specification, as indicating the scope of the invention.

I claim:

1. An assembly for mounting a globe of the type having a beaded or recess neck portion, comprising:

a receptacle including an annular skirt portin having an aperture therein;

a separate arcuate band adapted to be resiliently seated within the skirt portion, said band having circumferentially spaced projecting lugs and an aperture therein spaced from said lugs, said band aperture being constructed for alignment with the aperture in said holders; and securement means adapted to extend through said aligned apertures which in conjunction with said lugs will retain said globe securely within said holder.

2. An assembly according to claim 1 wherein said securement means comprises threads formed in wall portions of one or the other of said apertures and a machine screw threadably engaged therein.

3. An assembly according to claim 1 wherein the walls forming one of said apertures is threaded and said securement means comprises a machine screw.

4. An assembly according to claim 1 wherein said skirt of said skirt portion is of generally concave cross-sectional configuration.

5. An assembly for mounting a globe of a type having a beaded or recessed neck portion, comprising:

a receptacle including an annular skirt portion having an aperture therein;

a separate arcuate band resiliently seated within the skirt portion, said band having circumferentially spaced projecting lugs and an aperture therein spaced from said lugs, said band aperture being constructed for alignment with the aperture in said holder and a threaded bushing fixedly secured to said band and in alignment with said band aperture; and a machine screw extending through said aligned apertures and in threaded engagement with said bushing which in conjunction with said lugs retains said globe securely within said holder.

* * * * *